US008401431B2

(12) United States Patent
Ikeda

(10) Patent No.: US 8,401,431 B2
(45) Date of Patent: Mar. 19, 2013

(54) DEVELOPING DEVICE, IMAGE FORMING APPARATUS, AND IMAGE FORMING STRUCTURE

(75) Inventor: Miho Ikeda, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 321 days.

(21) Appl. No.: 12/790,163

(22) Filed: May 28, 2010

(65) Prior Publication Data

US 2011/0091228 A1 Apr. 21, 2011

(30) Foreign Application Priority Data

Oct. 19, 2009 (JP) ..... 2009-239983

(51) Int. Cl.
*G03G 15/08* (2006.01)

(52) U.S. Cl. ..... 399/253; 399/53; 399/274

(58) Field of Classification Search ..... 399/53, 399/253, 274
See application file for complete search history.

(56) References Cited

U.S. PATENT DOCUMENTS

2004/0114971 A1* 6/2004 Sakai et al. ..... 399/284
2005/0141915 A1* 6/2005 Okamoto ..... 399/103
2006/0204281 A1* 9/2006 Wada et al. ..... 399/227

FOREIGN PATENT DOCUMENTS

JP 05281844 A * 10/1993
JP A-10-198172 7/1998
JP A-2008-096472 4/2008

* cited by examiner

*Primary Examiner* — Walter L Lindsay, Jr.
*Assistant Examiner* — Benjamin Schmitt
(74) *Attorney, Agent, or Firm* — Oliff & Berridge, PLC

(57) ABSTRACT

A developing device includes: a developing device main body in which a developer chamber containing a developer is formed; a pressure application area forming unit that is provided in the developer chamber so as to form a pressure application area where pressure is applied to the developer in the developer chamber because of movement of the developer contained in the developer chamber; and a pressure regulating unit that regulates the pressure applied to the developer in the pressure application area in response to temperature of the developer in the pressure application area.

13 Claims, 10 Drawing Sheets

DEVELOPING DEVICE, IMAGE FORMING APPARATUS, AND IMAGE FORMING STRUCTURE

CROSS-REFERENCE TO RELATED APPLICATIONS

This application is based on and claims priority under 35 USC 119 from Japanese Patent Application No. 2009-239983 filed Oct. 19, 2009.

BACKGROUND

1. Technical Field

The present invention relates to a developing device, an image forming apparatus, and an image forming structure.

SUMMARY

According to an aspect of the invention, there is provided a developing device comprising: a developing device main body that a developer chamber containing a developer is formed; a pressure application area forming unit that is provided in the developer chamber so as to form a pressure application area where pressure is applied to the developer in the developer chamber because of movement of the developer contained in the developer chamber; and a pressure regulating unit that regulates the pressure applied to the developer in the pressure application area in response to temperature of the developer in the pressure application area.

BRIEF DESCRIPTION OF THE DRAWINGS

An exemplary embodiment of the present invention will be described in detail based on the following figures, wherein:

FIG. 10A is a view illustrating the pressure application area forming section under the condition that the temperature of a developer is below the predetermined; and FIG. 10B is a view illustrating the pressure application area forming section in the case that the temperature of the developer rises over the predetermined temperature from the state shown in FIG. 10A.

DETAILED DESCRIPTION

Next, an exemplary embodiment of the present invention will be described in detail below with reference to accompanying drawings.

Figure 1:
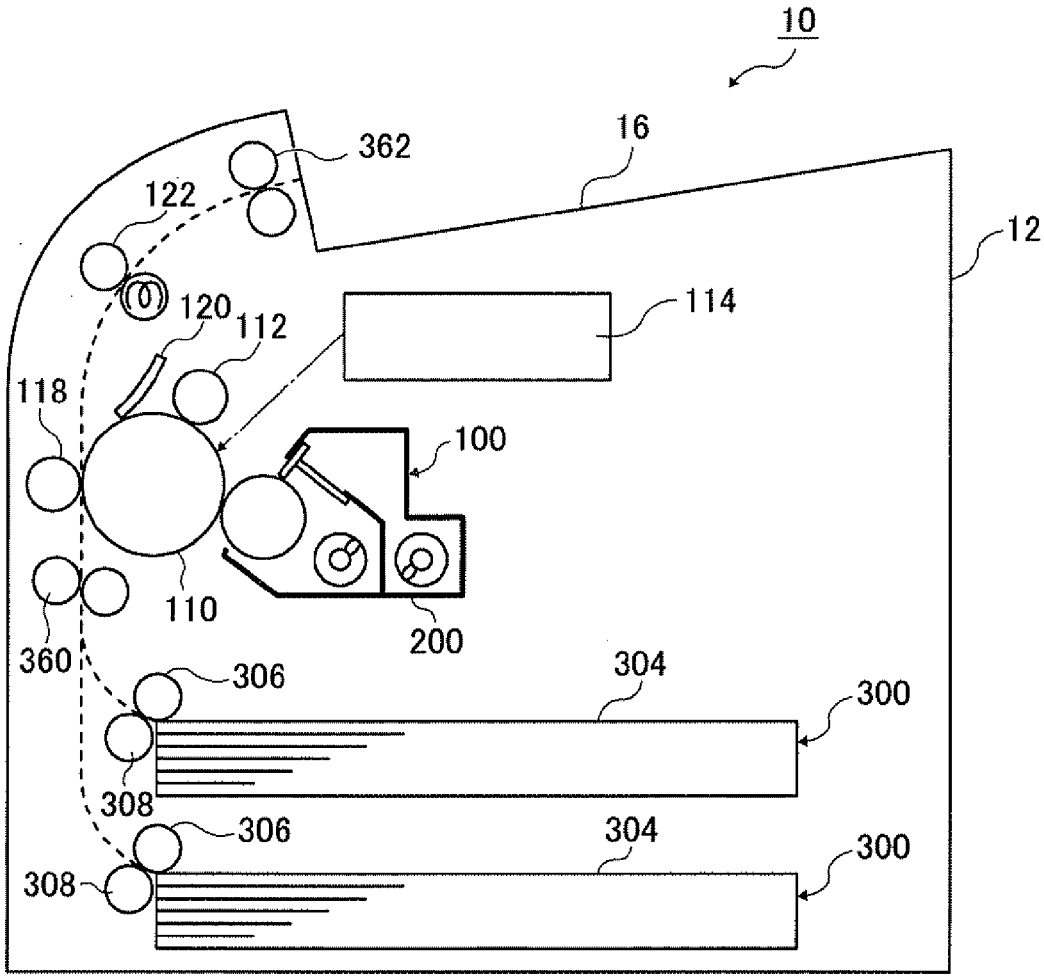
FIG. 1 is a cross-sectional view as seen from the right side view of an image forming apparatus according to a first exemplary embodiment of the present invention.

FIG. 1 shows an image forming apparatus 10 according to a first exemplary embodiment of the present invention. The image forming apparatus 10 has an image forming apparatus main body 12, whose the upper part serves as an output section 16 at which a sheet is output. Further, the image forming apparatus main body 12 has an image forming section 100 and e.g. two sheet supply devices 300.

The image forming section 100 has a photoreceptor 110 being in e.g. a drum-shape, employed an electrophotographic printing and serving as an image carrier holding a latent image, a charging device 112 uniformly charging the photoreceptor 110, a latent image forming device 114 forming a latent image by writing a latent image with a light on the photoreceptor 110 subjected to the charge of the charging device 112, a developing device 200 developing the latent image formed on the surface of the photoreceptor 110 by the latent image forming device 114, a transfer device 118 consisting of e.g. a transfer roller and transferring the developer image formed on the surface of the photoreceptor 110 by developing device 200 to a sheet, a cleaning device 120 with e.g. a cleaning blade scraping away developer particle remaining on the photoreceptor 110, and a fixing device 122 fixing the transferred developer image on the sheet with the transfer device 118 on the sheet. The latent image forming device 114 consists of e.g. a scanning laser exposure device, and forms a latent image on the photoreceptor 110. As other exemplary embodiment of the latent image forming device, a light emitting diode, a surface emitting device, or the like may be employed.

The sheet supply devices 300 have respectively a sheet container 304 consisting of e.g. a sheet feed cassette, a pick up roller 306 to pick up a topmost sheet contained in the sheet container 304, and a feed roller 308 to feed the sheet picked up by the pick up roller 306 toward downstream side of the sheet transporting direction. Therefore, the sheet supply devices 300 feed a sheet stacked in the sheet container 304 to the image forming section 100 respectively.

Downstream the feed roller 308 along a sheet feed direction, a registration roller 360 is disposed, and downstream the registration roller 360 the transfer device 118 and the photoreceptor 110 are disposed. Also the fixing device 362 is disposed downstream the transfer device 118 and the photoreceptor 110. An exit roller 362 outputs the sheet having a developer image fixed by the fixing device 122 thereon toward the output section 16.

Figure 2:
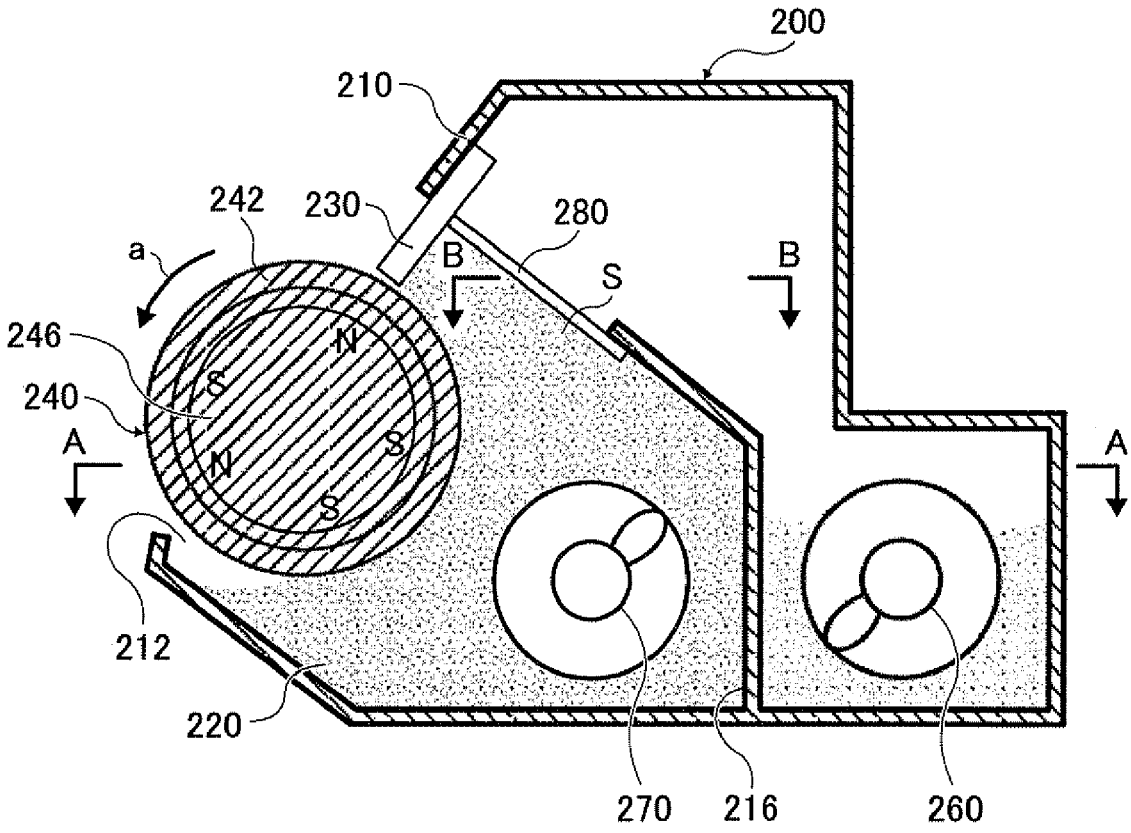
FIG. 2 is a cross-sectional view as seen from the right side view of a developing device provided in the image forming apparatus according to the first exemplary embodiment of the present invention shown in FIG. 1.
Figure 3:
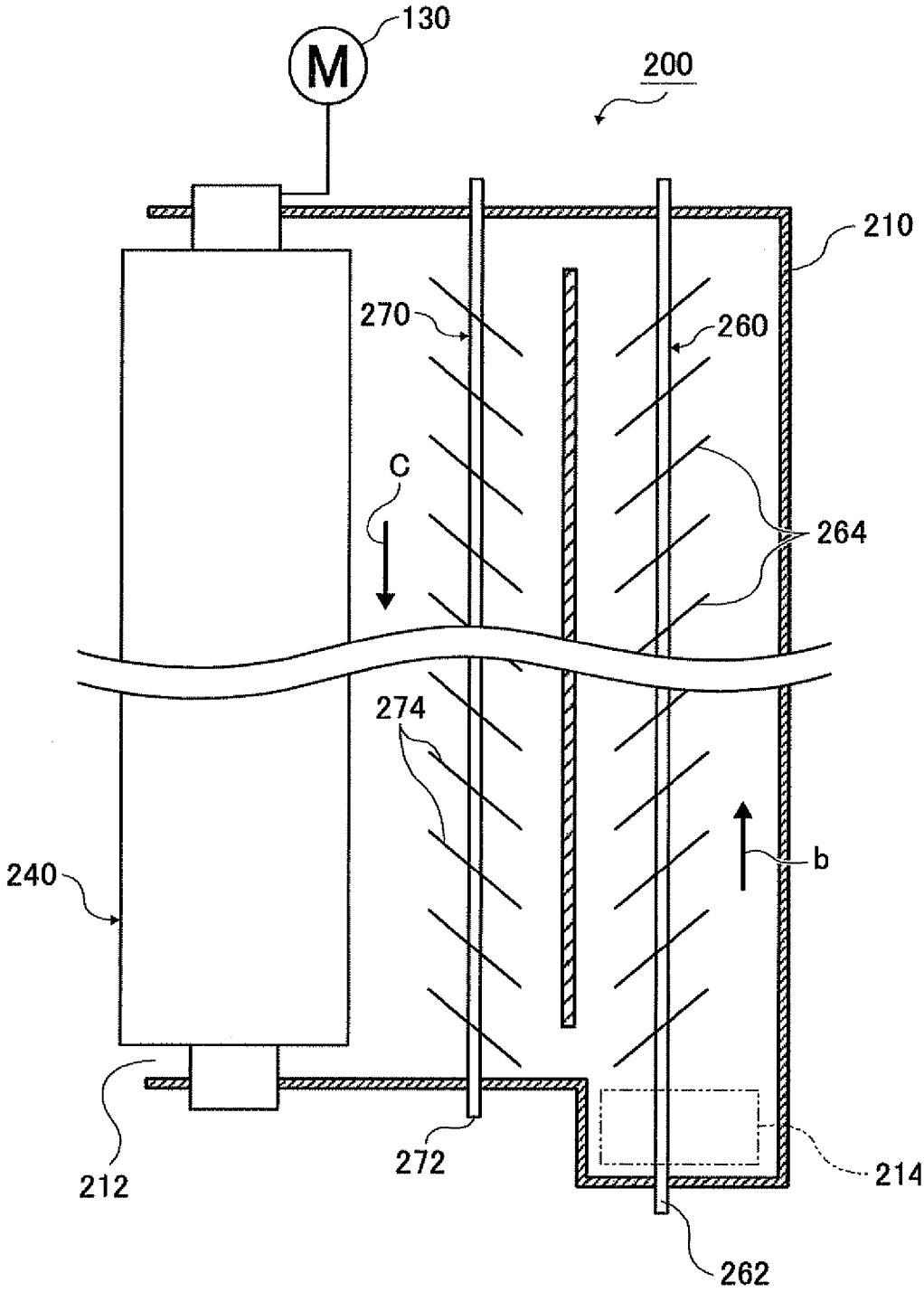
FIG. 3 is a cross-sectional view taken along line A-A of the developing device shown in FIG. 2.
Figure 4:
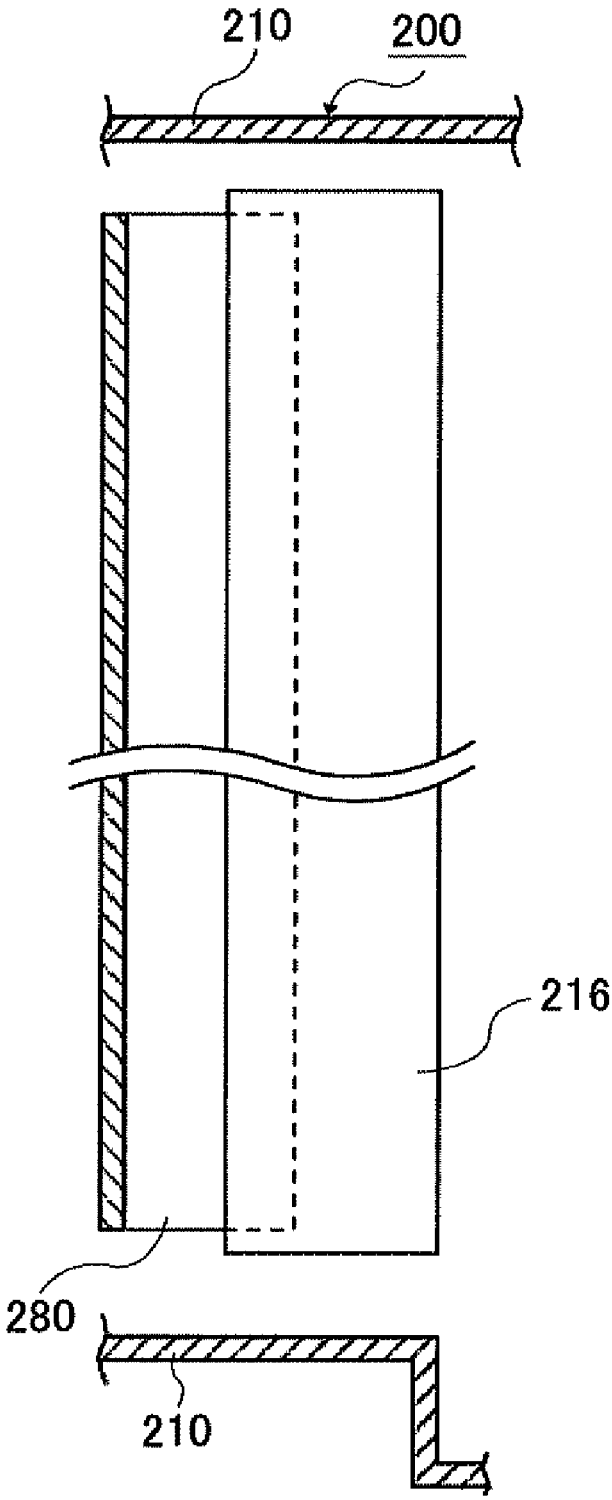
FIG. 4 is a cross-sectional view taken along line B-B of the developing device shown in FIG. 2.

FIGS. 2 to 4 illustrate the developing device 200.

The developing device 200 works with a two-component developer including a toner and a carrier for developing. That is, the two-component developer consisting of a nonmagnetic toner and a magnetic carrier is used in the developer device 200. The toner is a fine particle generated by attaching a color particle such as carbon to e.g. an electric charged plastic particle. The toner, charged due to e.g. friction, provides latent image development by electrostatically attaching a latent image. The carrier is a fine particle generated by coating a magnetic material with e.g. an epoxy resin or the like. When the carrier and the toner are mixed and stirred together, the carrier charges the toner, and accordingly the toner has electrical charge.

The developing device 200 is configured so as to be detachable in the image forming apparatus main body 12, and serves as an image forming structure attaching or removing to or from the image forming apparatus main body 12. As an alternative to the singly attachment or removal of the developing device 200 to or from the image forming apparatus main body 12, the image forming structure that, for instance, the developing device 200 and the entire or a part of the image forming section 100 except the developing device 200 are integrated may be detachable in the image forming apparatus main body 12.

As shown in FIG. 2 and FIG. 3, the developing device 200 has a developing device main body 210, which has a developing opening 212 opposite to the photoreceptor 110. The developing device main body 210 has a receiving opening 214 for receiving a toner particle supplied from a toner particle container omitted from the illustration. The developing device main body 210 further has a wall part 216 for separating in the developing device main body 210. The inner space of the developing device main body 210 serves as a developer chamber 220 for containing a developer, which the developer chamber 220 partially has an area in which pressure is applied to the developer contained in the developer chamber 220 because of movement of the developer, i.e. a pressure application area S. The developing device main body 210 further serves as the image forming structure attached or removed to or from the image forming apparatus main body 12.

Inside the developing device main body 210, a development roller 240, transport members 260 and 270, a layer thickness regulating member 230, and a pressure application area forming member 280 are disposed.

The development roller 240 is arranged in one side of the developing chamber 220 (the left side face of FIG. 2), and serves as a developer carrier for sending a developer by holding. The development roller 240 has a development sleeve 242 and a magnet roller 246 which is positioned inside the development sleeve 242 and fastened in the developing device main body 210.

The development sleeve 242 is cylindrically-shaped and made of e.g. aluminum. The development sleeve 242 is connected to a drive source 130 such as a motor with a power transmission mechanism (not shown) such as a gear. Thus, when the drive from the drive source 130 is transmitted, the development sleeve 242 turns around in the direction of the arrow mark a illustrated in FIG. 2. The magnet roller 246 has a plurality of South Pole and North Pole consisting of permanent magnets, in the appropriate position. Therefore, a carrier is attached on the surface of the development sleeve 242, and a magnetic brush is kept on the surface of the development sleeve 242.

The transport members 260 and 270 serve as transport sections for transporting the developer contained in the development roller 240 side of the separated space inside the developer chamber 220 (the front side of the developing device, left side face in FIG. 2) and the other side (the back side of the developing device, the right side face in FIG. 2) toward the development roller 240.

The transport member 260 has a shaft 262 mounted in the developing device main body 210 for rotating and plural blades 264 mounted on the shaft 262. Therefore, the transport member 260 turns around after receipt of the power transmitted from the drive source omitted from the illustration to transport the toner particles received at a receiving opening 214 and the developer contained in the developing device main body 210 from the right side (downside in FIG. 3) toward the left side (upside in FIG. 3) of the developing device main body 210 while stirring. The arrow mark b shown in FIG. 3 represents the transporting direction of the developer with the transport member 260.

The transport member 270 has a shaft 272 mounted in the developing device main body 210 for rotating and plural blades 274 mounted on the shaft 272. Therefore, the transport member 270 turns around after receipt of the power transmitted from the drive source omitted from the illustration to transport the developer transported by the transport member 260 and be in the left side of the developing device main body 210 toward the right side of the developing device main body 210 (downside in FIG. 3) while stirring. The arrow mark c shown in FIG. 3 represents the transporting direction of the developer with the transport member 260.

The layer thickness regulating member 230 is mounted on the developing device main body 210 so that a clearance is formed between the layer thickness regulating member 230 and the development sleeve 242 at a predetermined value. Therefore, when the development sleeve 242 turns around in the arrow mark a direction in FIG. 2, the layer thickness regulating member 230 regulates the layer thickness of the developer held on the development sleeve 242 by scraping an excess developer on the development sleeve 242 but remaining the developer in the predetermined thickness. After the scraping, the scraped developer by the layer thickness regulating member 230 stays in the developer chamber 220.

The pressure application area forming member 280 serves as a pressure application area forming unit and a pressure regulating unit. The pressure application area forming member 280 further serves as a discharge amount regulating unit for regulating an amount of the developer discharged from the pressure application area S in response to the temperature of the developer in the pressure application area S. The pressure application area forming member 280 furthermore serves as a discharge port forming unit for forming a discharge port 290 through which the developer is discharged from the pressure application area S (refer to FIG. 5).

One end of the pressure application area forming member 280 abuts or is close to the layer thickness regulating member 230, and the other end thereof is fastened to the wall part 216. Therefore, the arrangement of the pressure application area forming member 280 provides the pressure application area S surrounded with the pressure application area forming member 280, the layer thickness regulating member 230, and the development roller 240. As the described above, the pressure application area forming member 280 serves as the pressure application area forming unit which forms the pressure application area S in which pressure is applied to the developer contained in the developer chamber 220 because of movement of the developer.

In the pressure application area S, the developer transported by the transport member 270 and the developer scraped from the surface of the development sleeve 242 by the layer thickness regulating member 230 move in a circle with pressure, thereby the toner of the developer sufficiently charges. During the circulating, the developer heats in the pressure application area S due to e.g. heat from the drive source 130, the drive transmitting mechanism connecting the drive source 130 to the development sleeve 242, or the like. When the temperature of the developer rises in the pressure application area S, the fluidity and the circulation of the developer are reduced and thereby the density of the developer and the applied pressure against the developer increases in the pressure application area S. Thus, in the pressure application area S, the cohesion of the developer may occur, or the toner may not be sufficiently charged.

The pressure application area forming member 280 may be entirely constituted by e.g. a bimetallic strip. Note that, the bimetallic strip is a structure made of two or more metallic plates having different bending degree with temperature each other. The two or more kinds of metallic plates having a different thermal expansion coefficient each other are created by adding a material such as manganese, chrome, and copper to e.g. a Fe—Ni alloy. Further bonded the two or more kinds of metallic plates in e.g. cold-rolling, the bimetallic strip is produced. The bimetallic strip for the pressure application area forming member 280 may have a permissible temperature from −20 C.° to 150 C.° and the radius of the curvature more than $13\times10^{-6}$ K.

The radius of the curvature of the bimetallic strip k is a constant number defined by formula (I):

$$D=(k\times t)/(L\times L\times T)$$

wherein D represents an amount of change, i.e. a warp amount in millimeters; t represents a thickness of the bimetallic strip in millimeters; L represents a length of the bimetallic strip in millimeters; T represents a varying temperature; and k represents a radius of the curvature.

If the temperature of the developer is equal to or less than a predetermined value in the pressure application area S, as shown in FIG. 2, one end of the pressure application area forming member 280 abuts or is close to the layer thickness regulating member 230. The state prevents the developer in the pressure application area S from leaking from the position between the layer thickness regulating member 230 and the pressure application area forming member 280, and allows the developer in the pressure application area S to be subjected to pressure and charging compared to a state in which the developer easily leaks from the pressure application area S.

The upward facing surface, inclined and opposite from the surface contacting the pressure application area 5, of the pressure application area forming member 280 and the upward facing surface inclined of the wall part 216 serve as guides which guide the developer leaked from the pressure application area S toward the other end of the developer chamber 220 (the front side of the developing device 200, i.e. the left side face in FIG. 2) opposite from the one end in which the development roller 240 is arranged (the back side of the developing device 200, i.e. the right side face in FIG. 2).

Figure 5:
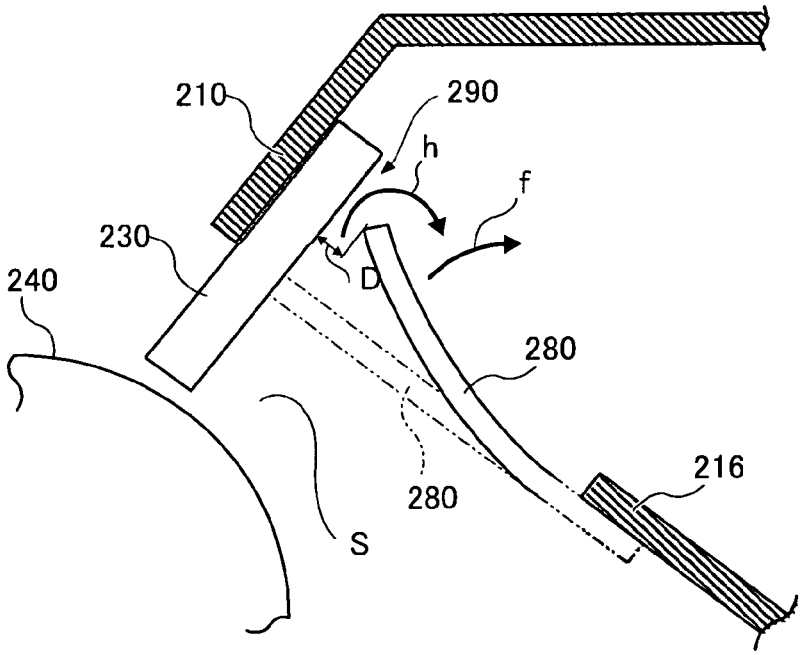
FIG. 5 is a right side view of a pressure application area forming section disposed in the developing device shown in FIG. 2.

FIG. 5 illustrates the pressure application area forming member 280.

As described above, when the temperature of the developer is equal to or less than the predetermined value in the pressure application area S, one end of the pressure application area forming member 280 abuts or is close to the layer thickness regulating member 230. However, when the temperature of the developer in the pressure application area S rises because of e.g. a heat transfer from the drive source 130, the pressure application area forming member 280 constituted by a bimetallic strip deforms in the direction of the arrow mark f in FIG. 5 so as to increase the amount of the developer discharged from the pressure application area S. That is, as shown in a solid line in FIG. 5, the pressure application area forming member 280 deforms so that the discharge port 290 defined a clearance between one end of the pressure application area forming member 280 and the layer thickness regulating member 230 at a width D is formed or so that the width D of the discharge port 290 widens.

When the developer is increasingly discharged from the pressure application area S in the direction of an arrow mark h shown in FIG. 5 because of the deformation of the pressure application area forming member 280 with temperature rising, the rise of the density of the developer and the rise of the pressure in the pressure application area S, caused by the temperature rising, are suppressed, and then the disadvantages that the developer is agglutinated and the toner particles of the developer is insufficiently charged is less likely to be caused.

As the temperature of the developer drops in the pressure application area S, the deformed pressure application area forming member 280 for discharging the developer deforms to reduce the discharge amount of the developer. That is, the deformation, toward the direction of two-dot chain line in FIG. 5, of the pressure application area forming member 280 with temperature falling provides the loss of the discharge port 290 defining a clearance between one end of the pressure application area forming member 280 and the layer thickness regulating member 230 at a width D or the reducing of the width D.

When the discharge amount of the developer in the pressure application area S decreases because of the deformation of the pressure application area forming member 280 with temperature falling, the pressure in the pressure application area S is likely to increase, and the toner particles is likely to be charged in the pressure application area S.

As described above, the pressure application area forming member 280 serves as the pressure application area forming unit and the pressure regulating unit. The pressure application area forming member 280 further serves as the discharge amount regulating unit that regulates the discharge amount of the developer discharged through the discharging port 290 from the pressure application area S with temperature of the developer in the pressure application area S. The pressure application area forming member 280 furthermore serves as the discharge port forming unit that forms the discharge port 290 through which the developer in the pressure application area S is discharged, and regulates a size of the discharge port 290 with the temperature of the developer in the pressure application area S.

Figure 6:
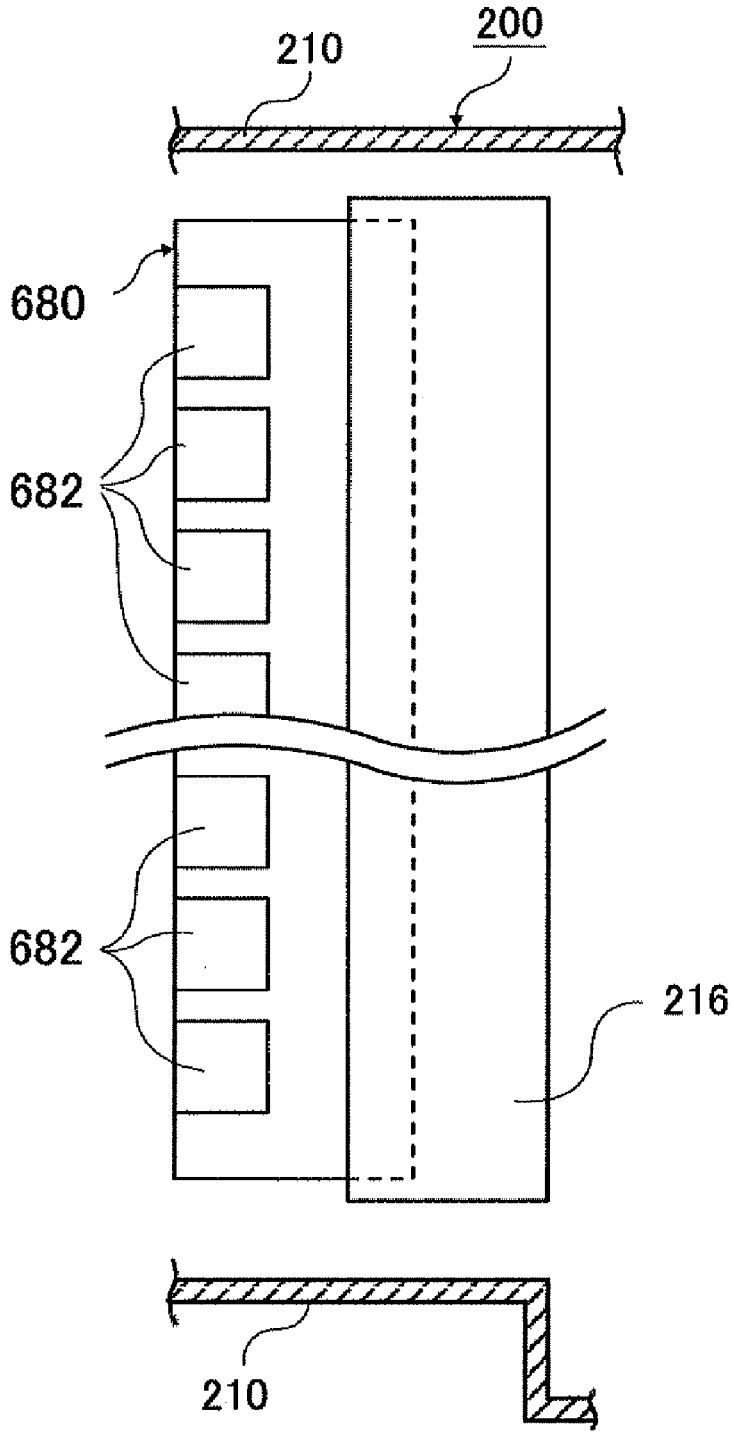
FIG. 6 is a view illustrating a modification example of the pressure application forming part disposed in the developing device according to the first exemplary embodiment of the present invention.

FIG. 6 illustrates the modified example of the pressure application area forming member 280.

The pressure application area forming member 280 according to the first exemplary embodiment of the present invention is entirely constituted by a bimetallic strip (refer to FIG. 4). However one end of the pressure application forming member 680 according to the modified example of the present invention, which abuts or is close to the layer thickness regulating member 230, has a bimetallic section 682 constituted by a bimetallic strip and partially arranged in one end thereof. Thus, the bimetallic section 682 deforms in response to the temperature of the developer in the pressure application area S in one end of the pressure application forming member 680.

Figure 7:
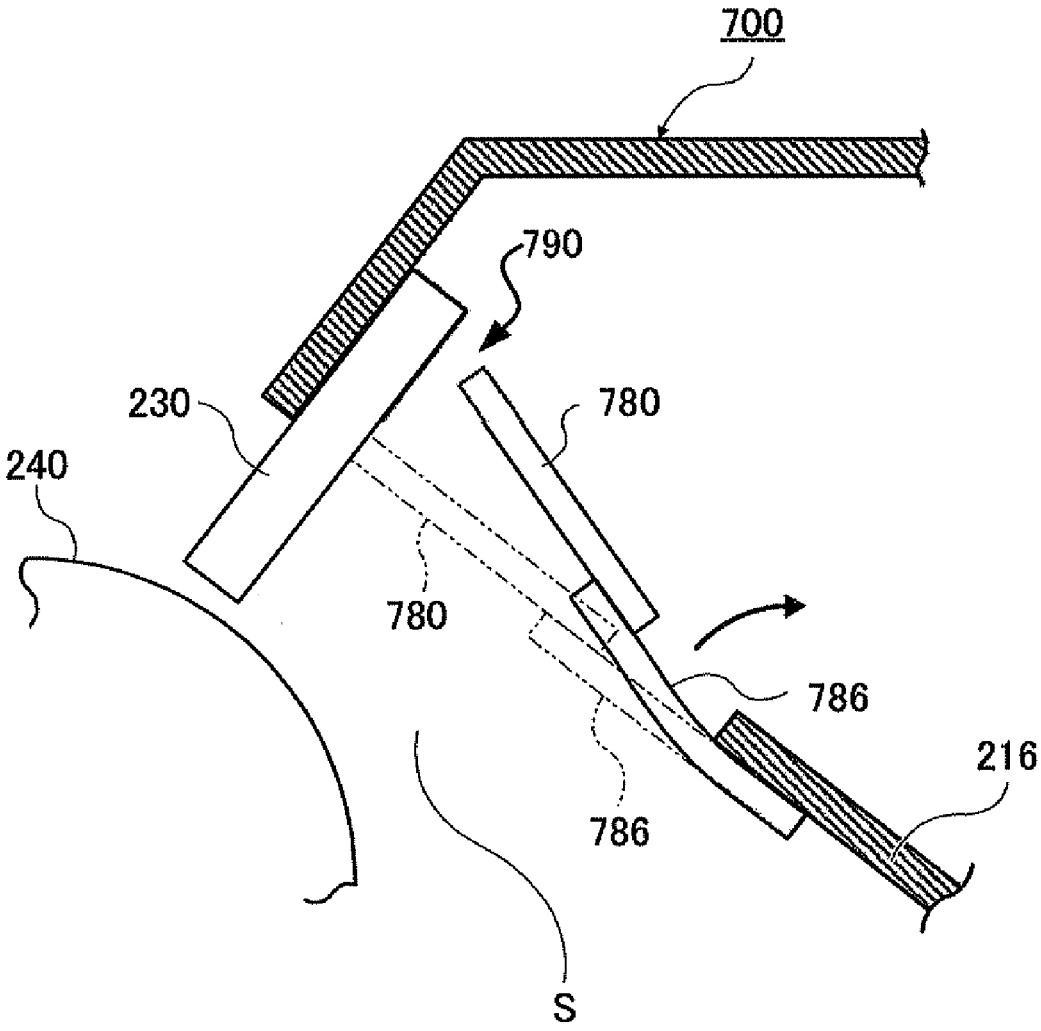
FIG. 7 is a right side view of a pressure application area forming section disposed in the developing device according to a second exemplary embodiment of the present invention.
Figure 8:
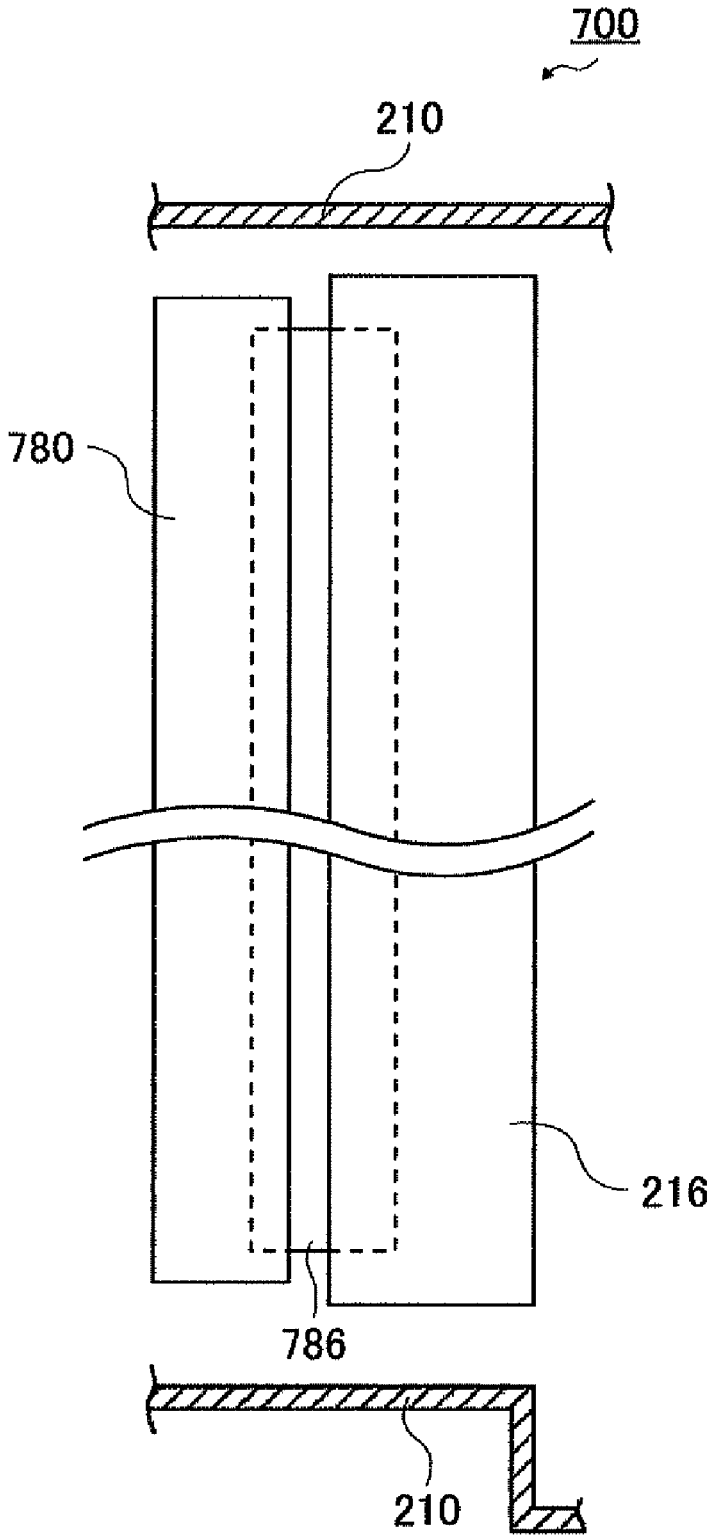
FIG. 8 is a plan view illustrating the pressure application area forming section disposed in the developing device of FIG. 7.

FIG. 7 and FIG. 8 illustrate a key part of the developing device 700 according to a second exemplary embodiment of the present invention. The developing device 200 according to the first exemplary embodiment described above has the pressure application area forming member 280, which serves as the pressure application area forming unit, the pressure regulating unit, the discharge amount regulating unit regulating the discharge amount of the developer discharged from the pressure application area S in response to the temperature of the developer in the pressure application area S, and the discharge port forming unit forming the discharge port 290 through which the developer in the pressure application area S is discharged. However, the developing device 700 according to the second exemplary embodiment of the present invention has a pressure application area forming member 780 and a support 786 supporting the pressure application area forming member 780, serving together as a pressure application area forming unit, a pressure regulating unit, a discharge amount regulating unit, and a discharge port forming unit.

The pressure application area forming member 780 is constituted by e.g. a plate made of aluminum. The support 786 constituted by a bimetallic strip has one end in which a pressure application area forming member 780 is mounted and the other end in which the wall part 216 is mounted.

When the temperature of the developer is equal to or less than the predetermined value in the pressure application area S, the pressure application area forming member 780 and the support 786 are in the position illustrated by two-dot chain line in FIG. 7, that one end of the pressure application area forming member 780 abuts or is close to a layer thickness regulating member 730. In the two-dot chain line position, when the temperature of the developer rises in the pressure application area S, since the support 786 constituted by a bimetallic strip deforms, the pressure application area forming member 780 is displaced as shown by a solid line in FIG. 7 so that the discharge amount of the developer from the pressure application area S increases.

When the temperature of the developer falls in the pressure application area 8, the pressure application area forming member 780, staying in the position to increase the discharge amount of the developer with temperature rising, is further displaced in the direction for reducing the discharge amount of the developer from the pressure application area S corresponding to the deformation of the support 786. That is, the pressure application area forming member 780 is displaced toward the position shown by a two-dot chain lines in FIG. 7 so as to lose the discharge port 790 or reduce the width of the discharge port 790.

Note that, the developing device 700 according to the second exemplary embodiment of the present invention has same components as the above image forming apparatus 10 according to the first exemplary embodiment except the described-above parts. Then, the description of the same components will be omitted, and the same components will be denoted the same reference numerals in the description of the second exemplary embodiment of the present invention.

Figure 9:
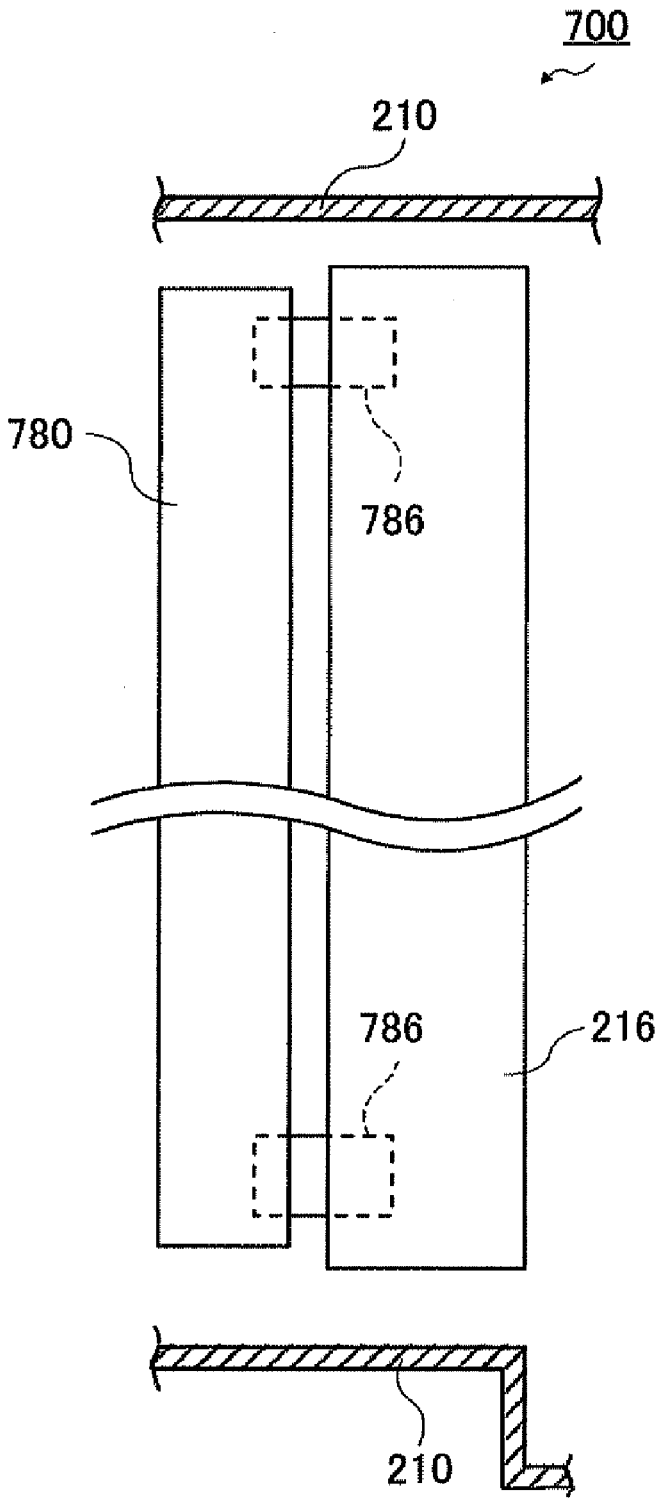
FIG. 9 is a plan view illustrating a modification example of the pressure application area forming section disposed in the developing device according to the second exemplary embodiment of the present invention.

FIG. 9 illustrates a modification example of the developing device 700 according to the second exemplary embodiment of the present invention.

While the developing device 700 of the second exemplary embodiment of the present invention described-above has the support 786 extending along a longitudinal direction of the development roller 240 (refer to FIG. 2) which supports the pressure application area forming member 780 singly (refer to FIG. 8), the modified developing device 700 has two supports 786 supporting together the pressure application area forming member 780.

FIG. 10 illustrates a key part of a developing device 1000 according to a third exemplary embodiment of the present invention. As described above, the pressure application area forming member 780 of the developing device 700 according to the second exemplary embodiment is supported by the support 786 having an approximately flat shape (refer to FIG. 7 and FIG. 8). However, in the developing device 1000 according to the third exemplary embodiment of the present invention, a support 1086 supporting a pressure application area forming member 1080 has a coil shape.

The pressure application area forming member 1080 is constituted by e.g. a plate made of aluminum as well as the pressure application area forming member 780 of the second exemplary embodiment. The support 1086, constituted by e.g. a bimetallic strip, is connected to the pressure application area forming member 1080 at the top. A left end and a right end of the pressure application area forming member 1080 are mounted inside the developing device main body 10.

Figure 10A:
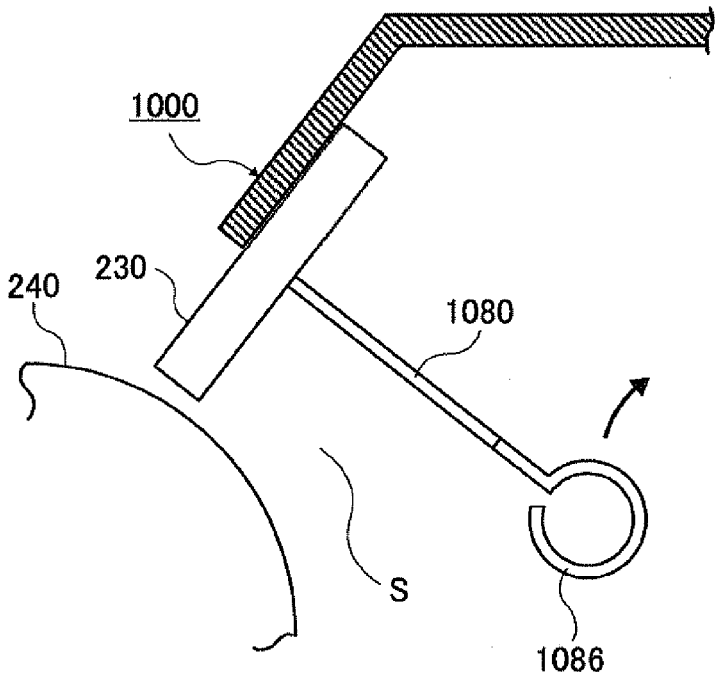
FIGS. 10A and 10B illustrate pressure application area forming sections, disposed in a developing device according to a third exemplary embodiment of the present invention.
Figure 10B:
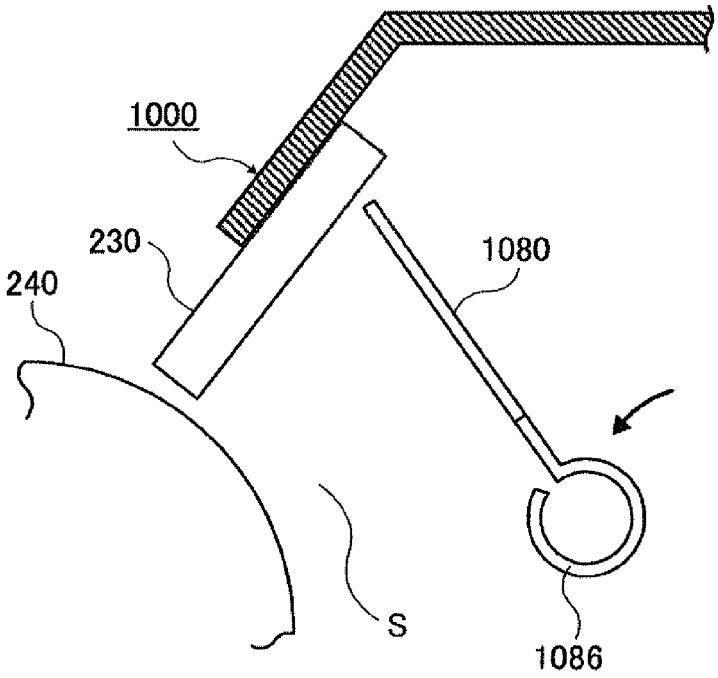

FIG. 10A explains the positions of the pressure application area forming member 1080 and the support 1086 in the case that the temperature of the developer is equal to or less than the predetermined value in the pressure application area S, and one end of the pressure application area forming member 1080 abuts or is close to the layer thickness regulating member 230. When the temperature of the developer rises in the pressure application area S, the pressure application area forming member 1080 staying in the position shown in FIG. 10A is displaced, as shown in FIG. 10B, in the direction for increasing the discharge amount of the developer from the pressure application area S corresponding to the deformation of the support 1086 constituted by a bimetallic strip.

As the temperature of the developer drops in the pressure application area S, the pressure application area forming member 1080 displaced for discharging the developer is displaced corresponding to the deformation of the support 1086 so as to reduce the discharge amount of the developer from the pressure application area S. That is, the pressure application area forming member 1080 is displaced to the position shown in FIG. 10A so as to lose the discharge port 290 between one end of the pressure application area forming member 1080 and the layer thickness regulating member 230 or reduce the width D of the discharge port 290.

Note that, the developing device 1000 according to the third exemplary embodiment of the present invention has same components as the above image forming apparatus 10 according to the first exemplary embodiment except the described-above parts. Then, the description of the same components will be omitted and the same components will be denoted the same reference numerals in the description of the third exemplary embodiment of the present invention.

In every exemplary embodiments described above, it is described herein that for instance the pressure application area forming member 280 constituted by a bimetallic strip allows regulation of the pressure applied to the developer, the discharge amount of the developer, and the size of the discharge port 290 with the temperature of the developer in the pressure application area S. Alternatively, the regulation of the pressure applied to the developer, the regulation of the discharge amount of the developer, and the regulation of the size of the discharge port 290 may be achieved by e.g. controlling mechanically the pressure application area forming member 280 in response to the temperature of the developer in the pressure application area S.

As described-above, the present invention is capable of being applied to an image forming apparatus such as a coping machine, a fax, and a printer and a developing device of these image forming apparatuses.

The forgoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developing device main body in which a developer chamber containing a developer is formed;

a pressure application area forming unit that is provided in the developer chamber so as to form a pressure application area where pressure is applied to the developer in the developer chamber because of movement of the developer contained in the developer chamber; and a pressure regulating unit that regulates the pressure applied to the developer in the pressure application area with a deformation element in response to temperature of the developer in the pressure application area; wherein, a portion of the deformation element is configured by joining at least two components with different thermal expansion coefficients.

2. The developing device according to claim 1, configured so as to reduce the pressure applied to the developer in the developer chamber with temperature of the developer rising.

3. The developing device according to claim 1 comprising:

a developer carrier that is arranged in one end side of the developer chamber and holds and transports the developer;

a guide that guides the developer discharged from the pressure application area to the other end side of the developer chamber; and a transport section that transports the guided developer to the other end side of the developer chamber toward the developer carrier.

4. A developing device comprising:

a developing device main body in which a developer chamber containing a developer is formed;

a pressure application area forming unit that is provided in the developer chamber so as to form a pressure application area where pressure is applied to the developer in the developer chamber because of movement of the developer contained in the developer chamber; and a discharge amount regulating unit that regulates the amount of the developer discharged from the pressure application area with a deformation element in response to temperature of the developer in the pressure application area; wherein, a portion of the deformation element is configured by joining at least two components with different thermal expansion coefficients.

5. The developing device according to claim 4, wherein the deformation element is at least partially deformed so that the discharge amount of the developer from the pressure application area increases with temperature of the developer rising in the pressure application area.

6. The developing device according to claim 4, wherein the deformation element is at least partially deformed so that the discharge amount of the developer from the pressure application area decreases with temperature of the developer falling in the pressure application area.

7. A developing device comprising:

a developing device main body in which a developer chamber containing a developer is formed;

a pressure application area forming unit that is provided in the developer chamber so as to form a pressure application area where pressure is applied to the developer in the developer chamber because of movement of the developer contained in the developer chamber; and a discharge port forming unit that forms a discharge port to be used for discharging the developer in the pressure application area, wherein the discharge port forming unit regulates a size of the discharge port in response to temperature of the developer in the pressure application area with a deformation element; wherein, a portion of the deformation element is configured by joining at least two components with different thermal expansion coefficients.

8. An image forming apparatus comprising:

an image carrier that holds a latent image; and a developing device that develops the latent image held on the image carrier with a developer, wherein the developing device has:

a developing device main body in which a developer chamber containing a developer is formed;

a pressure application area forming unit that is provided in the developer chamber so as to form a pressure application area where pressure is applied to the developer in the developer chamber because of movement of the developer contained in the developer chamber; and a pressure regulating unit that regulates the pressure applied to the developer in the pressure application area with a deformation element in response to temperature of the developer in the pressure application area; wherein, a portion of the deformation element is configured by joining at least two components with different thermal expansion coefficients.

9. An image forming apparatus comprising:

an image carrier that holds a latent image; and a developing device that develops the latent image held on the image carrier with a developer, wherein the developing device has:

a developing device main body in which a developer chamber containing a developer is formed;

a pressure application area forming unit that is provided in the developer chamber so as to form a pressure application area where pressure is applied to the developer in the developer chamber because of movement of the developer contained in the developer chamber; and a discharge amount regulating unit that regulates the amount of the developer discharged from the pressure application area with a deformation element in response to temperature of the developer in the pressure application area: wherein, a portion of the deformation element is configured by joining at least two components with different thermal expansion coefficients.

10. An image forming apparatus comprising:

an image carrier that holds a latent image; and a developing device that develops the latent image held on the image carrier with a developer, wherein the developing device has:

a developing device main body in which a developer chamber containing a developer is formed;

a pressure application area forming unit that is provided in the developer chamber so as to form a pressure application area where the pressure is applied to the developer in the developer chamber because of movement of the developer contained in the developer chamber; and a discharge port forming unit that forms discharge port to be used for discharging the developer in the pressure application area, wherein the discharge port forming unit regulates a size of the discharge port in response to temperature of the developer in the pressure application area with a deformation element; wherein, a portion of the deformation element is configured by joining at least two components with different thermal expansion coefficients.

11. An image forming structure comprising:

an image forming structure main body that is attached to or removed from an image forming apparatus main body and has a developer chamber containing a developer;

a pressure application area forming unit that is provided in the developer chamber so as to form a pressure application area where pressure is applied to the developer in the developer chamber because of movement of the developer contained in the developer chamber; and a pressure regulating unit that regulates the pressure applied to the developer in the pressure application area with a deformation element in response to temperature of the developer in the pressure application area; wherein, a portion of the deformation element is configured by joining at least two components with different thermal expansion coefficients.

12. An image forming structure comprising:

an image forming structure main body that is attached to or removed from an image forming apparatus main body and has a developer chamber storing a developer;

a pressure application area forming unit that is provided in the developer chamber so as to form a pressure application area where pressure is applied to the developer in the developer chamber because of movement of the developer contained in the developer chamber; and a discharge amount regulating unit that regulates the amount of the developer discharged from the pressure application area with a deformation element in response to temperature of the developer in the pressure application area; wherein, a portion of the deformation element is configured by joining at least two components with different thermal expansion coefficients.

13. An image forming structure comprising:

an image forming structure main body that is attached or removed to or from the image forming apparatus main body and has a developer chamber containing a developer;

a pressure application area forming unit that is provided in the developer chamber so as to form a pressure application area where pressure is applied to the developer in the developer chamber because of movement of the developer contained in the developer chamber; and a discharge port forming unit that forms a discharge port to be used for discharging the developer from the pressure application area, wherein the discharge port forming unit regulates a size of the discharge port in response to temperature of the developer in the pressure application area with a deformation element; wherein, a portion of the deformation element is configured by joining at least two components with different thermal expansion coefficients.

* * * * *